US007688269B1

(12) United States Patent
West

(10) Patent No.: US 7,688,269 B1
(45) Date of Patent: Mar. 30, 2010

(54) STACKED DUAL-BAND ELECTROMAGNETIC BAND GAP WAVEGUIDE APERTURE WITH INDEPENDENT FEEDS

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 261 days.

(21) Appl. No.: 11/495,380

(22) Filed: Jul. 28, 2006

(51) Int. Cl.
*H01Q 3/36* (2006.01)
*H01P 5/12* (2006.01)

(52) U.S. Cl. ..... 343/776; 333/125; 333/137; 343/853

(58) Field of Classification Search ..... 333/125, 333/137; 343/776, 853
See application file for complete search history.

(56) References Cited

U.S. PATENT DOCUMENTS 4,725,796 A * 2/1988 Youree et al. ..... 333/135
4,998,113 A * 3/1991 Raghavan et al. ..... 343/776
6,756,866 B1 6/2004 Higgins
6,822,617 B1 11/2004 Mather et al.
6,950,062 B1 9/2005 Mather et al.

OTHER PUBLICATIONS

"Characteristics of Ka Band Waveguide Using Electromagnetic Crystal Sidewalls", by J. A. Higgins et al., 2002 IEEE MTT-S International Microwave Symposium, Seattle, WA, Jun. 2002.
"A Dual-Frequency Band Waveguide Using FSS", R. J. Langley, IEEE Microwave and Guided Wave Letters, vol. 3, No. 1, Jan. 1993.
U.S. Appl. No. 11/154,256, filed Jun. 16, 2005, entitled "Low-Loss, Dual-Band Electromagnetic Band Gap Electronically Scanned Antenna Utilizing Frequency Selective Surfaces" By Brian J. Herting.

* cited by examiner

*Primary Examiner*—Benny Lee
(74) *Attorney, Agent, or Firm*—Matthew J. Evans; Daniel M. Barbieri

(57) ABSTRACT

A dual-band stacked electromagnetic band gap (EBG) electronically scanned array (ESA) has a high-frequency aperture stacked on a low-frequency aperture. The high-frequency aperture looks through the low-frequency aperture. Low-frequency and high-frequency feeds feed the apertures. The low-frequency aperture comprises low-frequency cells with two vertical low-frequency EBG sidewalls and two horizontal metal walls. The high-frequency aperture comprises high-frequency cells with four cells stacked on each of the low-frequency cells. The four high-frequency cells comprise four vertical high-frequency EBG sidewalls, two horizontal metal top and bottom metal walls, and a center horizontal metal wall for operation with the same polarization as the low-frequency aperture. The high-frequency cells may comprise four horizontal high-frequency EBG sidewalls, two vertical left and right metal walls, and a center vertical metal wall for orthogonal polarization. A frequency selective surface may be used to provide isolation between the apertures.

18 Claims, 11 Drawing Sheets

STACKED DUAL-BAND ELECTROMAGNETIC BAND GAP WAVEGUIDE APERTURE WITH INDEPENDENT FEEDS

CROSS REFERENCE TO RELATED APPLICATIONS AND PATENTS

The present application is related to co-filed application Ser. No. 11/495,381 entitled "Stacked Dual-Band Electromagnetic Band Gap Waveguide Aperture for an Electronically Scanned Array" by Brian J. Herting. The present application is related to application Ser. No. 11/154,256 filed on Jun. 16, 2005 entitled "Low-Loss, Dual-Band Electromagnetic Band Gap Electronically Scanned Antenna Utilizing Frequency Selective Surfaces" by Brian J. Herting, now issued as U.S. Pat. No. 7,151,508. The present application is related to U.S. Pat. No. 6,822,617 entitled "A Construction Approach for an EMXT-Based Phased Array Antenna" by John C. Mather, Christina M. Conway, James B. West, Gary E. Lehtola, and Joel M. Wichgers; and U.S. Pat. No. 6,950,062 entitled "A Method and Structure for Phased Array Antenna Interconnect" by John C. Mather, Christina M. Conway, and James B. West. The patents and applications are incorporated by reference herein in their entirety. The application and patents are assigned to the assignee of the present application.

BACKGROUND OF THE INVENTION

This invention relates to antennas, phased array antennas, and specifically to a stacked dual-band electromagnetic band gap (EBG) waveguide aperture with independent feeds.

Electronically scanned arrays or phased array antennas offer significant system level performance enhancements for advanced communications, data link, radar, and SATCOM systems. The ability to rapidly scan the radiation pattern of the ESA allows the realization of multi-mode operation, LPI/LPD (low probability of intercept and detection), and A/J (antijam) capabilities. One of the major challenges in ESA design is to provide cost effective antenna array phase shifting methods and techniques along with dual-band operation of the ESA.

It is well known within the art that the operation of a phased array is approximated to the first order as the product of the array factor and the radiation element pattern as shown in Equation 1 for a linear array.

$$E_A(\theta) \equiv \underbrace{E_p(\theta,\phi)}_{\text{Radiation Element Pattern}} \underbrace{\left[\frac{\exp\left(-j\frac{2\pi r_o}{\lambda}\right)}{r_o}\right]}_{\text{Isotropic Element Pattern}} \cdot \underbrace{\sum_N A_n \exp\left[-j\frac{2\pi}{\lambda} n\Delta x(\sin\theta - \sin\theta_o)\right]}_{\text{Array Factor}} \qquad \text{Equation 1}$$

$\theta$=angle of beam scanning (steering) to the far field observation point as referenced to the nominal beam angle, as described by the array coordinate system. This is typically the angle from an axis normal (perpendicular) to the array face. It is often referenced from the z axis of a right-handed spherical coordinate system and often describes the "elevation angle" of the array main beam relative to its nominal position.

$\phi$=the angle referenced from the x axis of a right handed spherical coordinate system and often describes the "azimuth angle" of the array main beam relative to its nominal position.

$j=\sqrt{(-1)}$ the imaginary number operator $\lambda$=the free space wavelength of the signal radiated by the linear array $\pi$=the mathematical constant 3.14159 . . .

$r_o$=the radial distance from the array center to the far field observation point $A_n$=the relative amplitude weighting of each element within the linear array n=the number of radiating elements in the linear array $\Delta x$=the physical spacing between each element in the linear array $\theta_0$=the angle of the array's nominal beam position, as point referenced to the array coordinate system. It is usually the angle referenced of the z axis of a right-handed spherical coordinate system. This is the reference angle in which the amount of beam scanning, as described by $\theta$, is referenced, and is typically 0° or 90° in application.

Standard spherical coordinates are used in Equation 1 and $\theta$ is the scan angle referenced to bore sight of the array. Introducing phase shift at all radiating elements within the array changes the argument of the array factor exponential term in Equation 1, which in turns steers the main beam from its nominal position. Phase shifters are RF devices or circuits that provide the required variation in electrical phase. Array element spacing is related to the operating wavelength and sets the scan performance of the array. All radiating element patterns are assumed to be identical for the ideal case where mutual coupling between elements does not exist. The array factor describes the performance of an array of isotropic radiators arranged in a prescribed two-dimensional rectangular grid.

A packaging, interconnect, and construction approach is disclosed in U.S. Pat. No. 6,822,617 that creates a cost-effective EMXT (electromagnetic crystal)-based phased array antenna having multiple active radiating elements in an X-by-Y configuration. EMXT devices are also known in the art as tunable photonic band gap (PBG) and tunable electromagnetic band gap (EBG) substrates. A description of a waveguide section with tunable EBG phase shifter technologies is available in a paper by J. A. Higgins et al. "Characteristics of Ka Band Waveguide using Electromagnetic Crystal Sidewalls" 2002 IEEE MTT-S International Microwave Symposium, Seattle, Wash., June 2002 and U.S. Pat. No. 6,756,866 "Phase Shifting Waveguide with Alterable Impedance Walls and Module Utilizing the Waveguides for Beam Phase Shifting and Steering" by John A. Higgins. Each element is comprised of EMXT sidewalls and a conductive (metallic) floor and ceiling. Each EMXT device requires a bias voltage plus a ground connection in order to control the phase shift for each element of the antenna by modulating the sidewall impedance of the waveguide. By controlling phase shift performance of the elements, the beam of the antenna can be formed and steered.

Phase shifter operation in dual modes in one common waveguide with independent phase control for each mode at the same or different frequency bands for phased array antennas and other phase shifting applications is a desirable feature to increase performance and reduce cost and size. Dual bands of current interest include K Band (20 GHz downlink) and Q Band (44 GHz uplink) for satellite communication (SATCOM) initiatives. The EBG ESA must be able to perform at two significantly different frequencies.

Dual-band EBG ESA antennas are constructed of square EBG waveguide phase shifters. The waveguide aperture size is determined so as to maximize phase shift while minimizing loss. Smaller apertures yield greater phase shift per unit length, but higher loss due to input mismatch. As the frequencies of a dual-band EBG ESA are made further apart, the task of achieving low-loss 360° phase shifter performance becomes daunting. Dual-band EBG 360° analog waveguide phase shifters for use in ESA antenna apertures are difficult to design due to the difference in performance tradeoffs encountered at each frequency.

What is needed is a low-cost, low-loss, dual-band EBG ESA waveguide antenna utilizing techniques that enable dual frequency operation, especially in the case of significantly different operating frequencies.

SUMMARY OF THE INVENTION

A dual-band stacked electromagnetic band gap (EBG) electronically scanned array (ESA) with independent feeds is disclosed. The dual-band stacked EBG ESA comprises a low-frequency aperture and a high-frequency aperture stacked on the low-frequency aperture so that the high-frequency aperture looks through the low-frequency aperture. A low-frequency feed feeds the low-frequency aperture at the low frequency. A high-frequency feed is stacked on the high-frequency aperture to feed the high-frequency aperture at the high frequency.

The low-frequency aperture comprises a plurality of low-frequency cells. Each of the cells comprises two vertical low-frequency EBG sidewalls and two horizontal metal walls.

The high-frequency aperture comprises a plurality of high-frequency cells. Four of the high-frequency cells are stacked on each of the low-frequency cells. The four high-frequency cells may comprise four vertical high-frequency EBG sidewalls, two horizontal metal top and bottom metal walls, and a center horizontal metal wall. The low-frequency aperture and the high-frequency aperture have the same polarization with this configuration.

The high-frequency aperture high-frequency cells may comprise four horizontal high-frequency EBG sidewalls, two vertical left and right metal walls, and a center vertical metal wall. The low-frequency aperture and the high-frequency aperture have an orthogonal polarization with this configuration.

A frequency selective surface may be placed between the low-frequency aperture and the high-frequency aperture to provide isolation between the two apertures. The frequency selective surface comprises a plurality of unit cells etched on high-frequency material substrates.

The low-frequency feed feeds the low-frequency aperture from the bottom and may be a series-series or a parallel-series constrained or semi-constrained feed architecture. The high-frequency feed feeds the high-frequency aperture from a face and may be a space feed, a semi-constrained feed, or a constrained feed.

It is an object of the present invention to provide dual-band EBG analog waveguide phase shifters for use in ESA antenna apertures.

It is an object of the present invention to create two different EBG waveguide apertures and stack them to form a single aperture capable of providing adequate phase shift at both low and high operating frequencies while minimizing loss.

It is an advantage of the present invention to provide about 360° phase shift at widely spaced frequencies.

It is an advantage of the present invention to provide dual-band operation with the same polarization or orthogonal polarization.

It is a feature of the present invention to provide the benefit of independent beam steering for two frequencies.

It is a feature of the present invention to provide a low-cost dual-band EBG ESA with simple construction.

BRIEF DESCRIPTION OF THE DRAWINGS

The invention may be more fully understood by reading the following description of the preferred embodiments of the invention in conjunction with the appended drawings wherein.

DETAILED DESCRIPTION OF THE INVENTION

The present invention is for a dual-band stacked electromagnetic band gap (EBG) waveguide aperture electronically scanned array (ESA) antenna with independent feeds.

Figure 1:
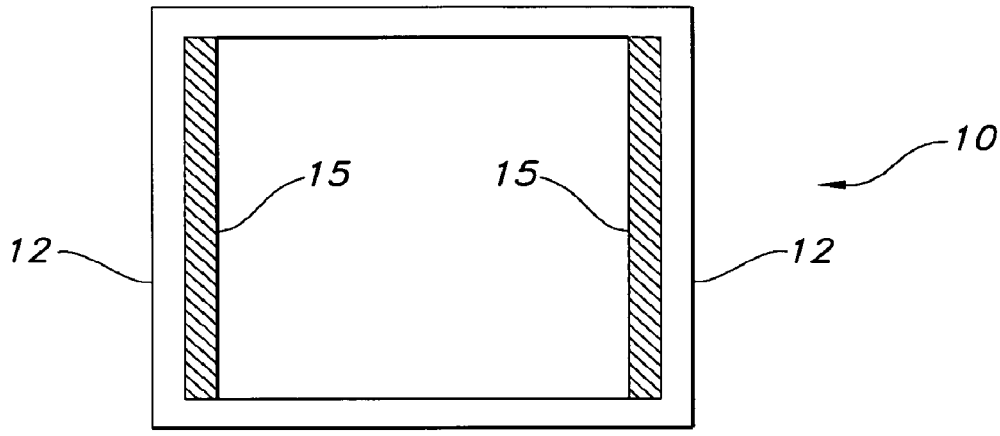
FIG. 1 (PRIOR ART)
FIG. 1 is a diagram of a prior art single-mode analog waveguide phase shifter using electromagnetic band gap (EBG) device sidewalls.

A prior art single-mode analog waveguide phase shifter 10 using electromagnetic band gap (EBG) devices 15 on waveguide sidewalls 12 is shown in FIG. 1 and is described in the referenced paper by J. A. Higgins et al. and disclosed in U.S. Pat. No. 6,756,866. The references describe electromagnetic crystal (EMXT) devices implemented with EBG materials. EBG materials are periodic dielectric materials that forbid propagation of electromagnetic waves in a certain frequency range. The EBG material may be GaAs, ferroelectric, ferromagnetic, or any suitable EBG embodiment. EMXT device and EBG device are used interchangeably in the following description.

Figure 2A:
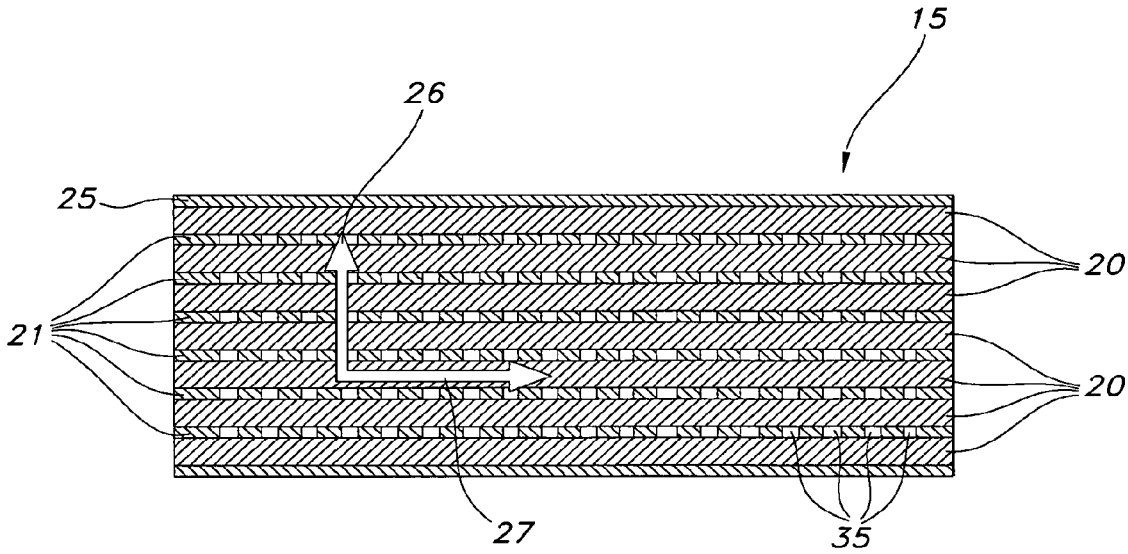
FIG. 2a (PRIOR ART)
FIG. 2*a* is a top view of a prior art electromagnetic band gap device sidewall used in the waveguide phase shifter of FIG. 1.
Figure 2B:
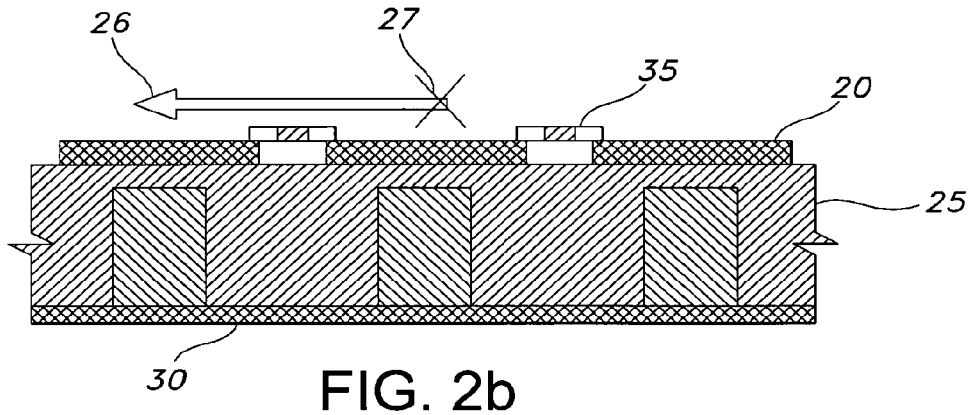
FIG. 2b (PRIOR ART)
FIG. 2*b* is a physical cross section view of the prior art electromagnetic band gap device of FIG. 2*a;*
Figure 2C:
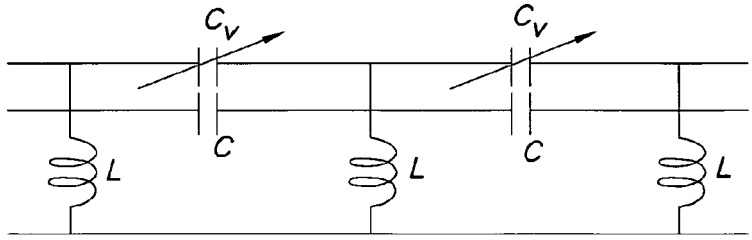
FIG. 2c (PRIOR ART)
FIG. 2*c* is an electrical circuit representation of the prior art electromagnetic band gap device of FIGS. 2*a* and 2*b* where L is a distributed inductance (Henrys) per unit length, C is a distributed capacitance (Farads) per unit length, and $C_v$ is the tuning capacitance (Farads)
Figure 3:
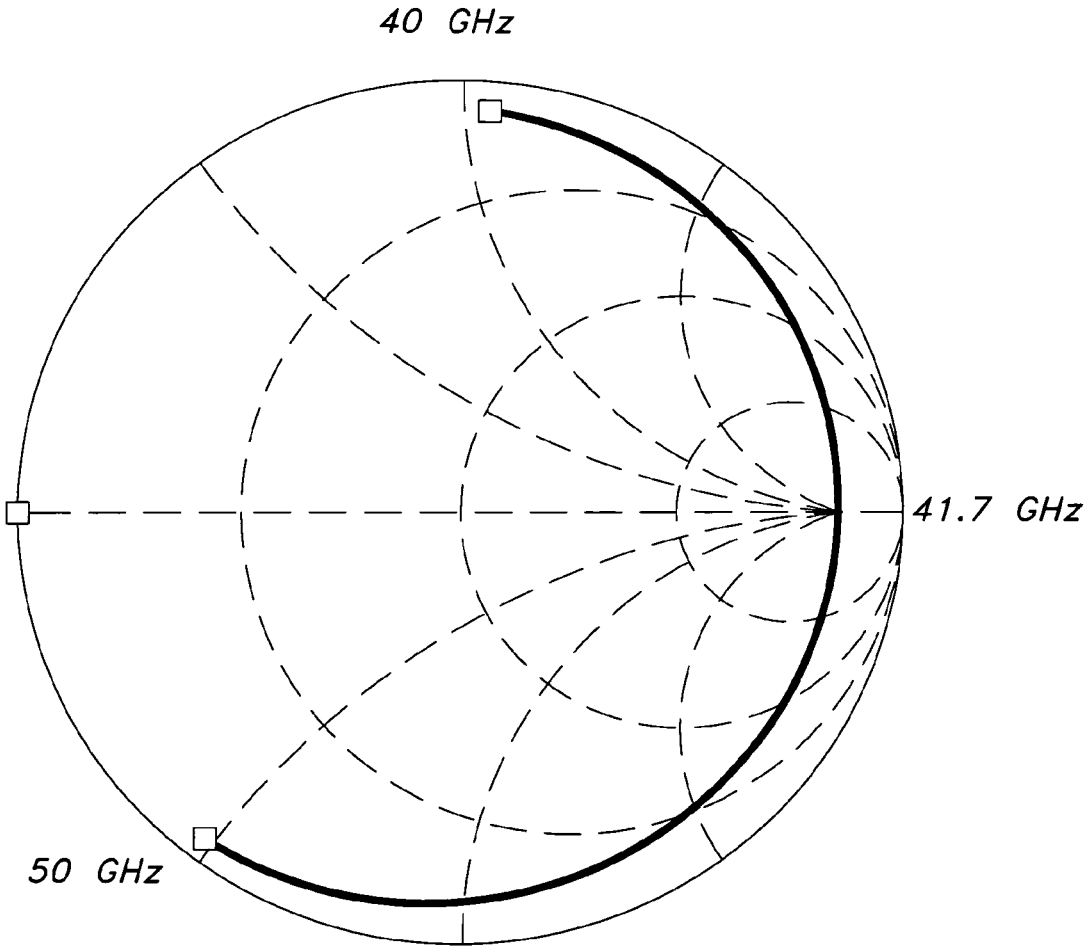
FIG. 3 (PRIOR ART)
FIG. 3 is a Smith chart (prior art) showing high impedance at resonance of the electromagnetic band gap devices.

The waveguide sidewalls 12 of the prior art single-mode EBG waveguide phase shifter 10 in FIG. 1 each contain an EBG device 15 that consists of a periodic surface of conductive strips 20 that may be metal separated by gaps 21 (FIG. 2*a*) over a surface of a dielectric substrate 25 as shown in FIG. 2*a* and FIG. 2*b*. These strips 20 capacitively couple to each other, and inductively couple to a ground plane 30 on an opposite surface of the substrate 25 as shown in FIG. 2*b*. This structure creates a LC tank circuit shown in FIG. 2*c* that resonates at a desired frequency. Near the desired resonant frequency, the EBG device 15 surface appears as a high impedance to a wave traveling down the waveguide as shown in FIG. 3, thus allowing a tangential electric field to exist on the EBG sidewall. A Smith chart plot of complex surface impedance (real+j (imaginary)) of the EBG structure as a function of frequency, shows resonance at 41.7 GHz. Since the high impedance also limits current flow, the tangential magnetic field is forced to zero. The fundamental mode of such a structure is therefore TEM (transverse electromagnetic) having a uniform vertical electric field shown by arrow 26 and a uniform horizontal magnetic field (not shown), both transverse to the direction of propagation shown by arrow 27 in FIGS. 2*a* and 2*b*.

Various methods of tuning the EBG device 15 exist. The most developed is a plurality of reactive devices 35 such as varactor or Schottky diodes placed periodically between the strips 20 to vary a reactance, as shown in FIGS. 2*a* and 2*b*. By adjusting a reverse bias voltage on the diodes 35 applied via the conductive metallic strips 20 from a control source (not shown), the capacitive coupling between the strips 20 is altered as shown by a variable capacitor Cv in FIG. 2*c*, and the overall surface impedance of the EBG device 15 shifts. With a shift in the surface impedance of the EBG devices 15 on the waveguide sidewalls 12, the propagation velocity of the wave is also modulated. The insertion phase of the element can therefore be actively controlled, resulting in a 360° analog phase shifter, for a sufficiently long element.

The tunable EBG device 15 may be implemented in semiconductor MMIC (monolithic microwave integrated circuit) technology. Gallium arsenide (GaAs) and indium phosphide (InP) semiconductor substrates 25 are currently practical, but other III-V compounds are feasible. In these implementations the semiconductor substrate 25 acts as a passive (non-tunable) dielectric material, and tunability is obtained with the reactive devices 35 such as varactor or Schottky diodes in FIG. 2*b* connected across the conductive strips 20. The semiconductor device tuning elements, the top side metal geometries and the back side bias control signal line interconnections are all realized by means of commonly know semiconductor fabrication techniques.

Ferroelectric and ferromagnetic tunable EBG substrates may be used in the EMXT device 15 as the dielectric substrate 25 of FIGS. 2*a* and 2*b*. Here the dielectric constant and the permeability are varied with a bias applied to the conductive strips 20 to tune the EMXT device 15. Metal deposition techniques are used to form the required top-side metallic geometries and back side bias control signal line interconnections.

Ferroelectric and ferromagnetic materials are known to exhibit electrical parameters of relative permittivity and/or permeability that can be altered or tuned by means of an external stimulus such as a DC bias field. It should be noted, however, that the concepts described herein are equally applicable to any materials that exhibit similar electrical material parameter modulation by means of an external stimulus signal.

Substrates with adjustable material parameters, such as ferroelectric or ferromagnetic materials can be fabricated monolithically, i.e. in a continuous planar substrate without segmentation or subassemblies, through thin film deposition, ceramic fabrication techniques, or semiconductor wafer bulk crystal growth techniques. An example of bulk crystal growth is the Czochralski crystal pulling technique that is known within the art to grow germanium, silicon and a wide range of compound semiconductors, oxides, metals, and halides.

EMXT devices may be fabricated on soft substrates such as high-frequency material substrates using printed circuit techniques. A standard printed circuit board print and etch technique may be used to pattern the EMXT surface metal. The tuning devices may then be placed on the substrate using any automated placement technique such as standard pick and place or fluidic self assembly.

Figure 4:
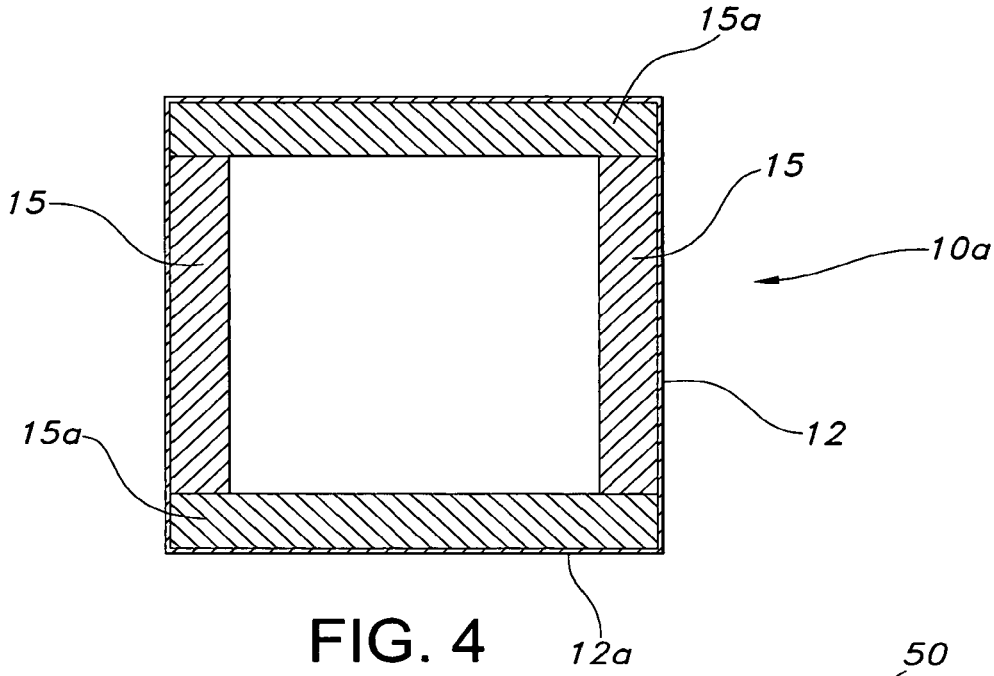
FIG. 4 (PRIOR ART)
FIG. 4 shows the prior art waveguide phase shifter of FIG. 1 modified into a dual-band phase shifter with EBG devices on vertical waveguide walls of a square waveguide for low-frequency operation and EBG devices on horizontal waveguide walls for high-frequency operation.
Figure 5:
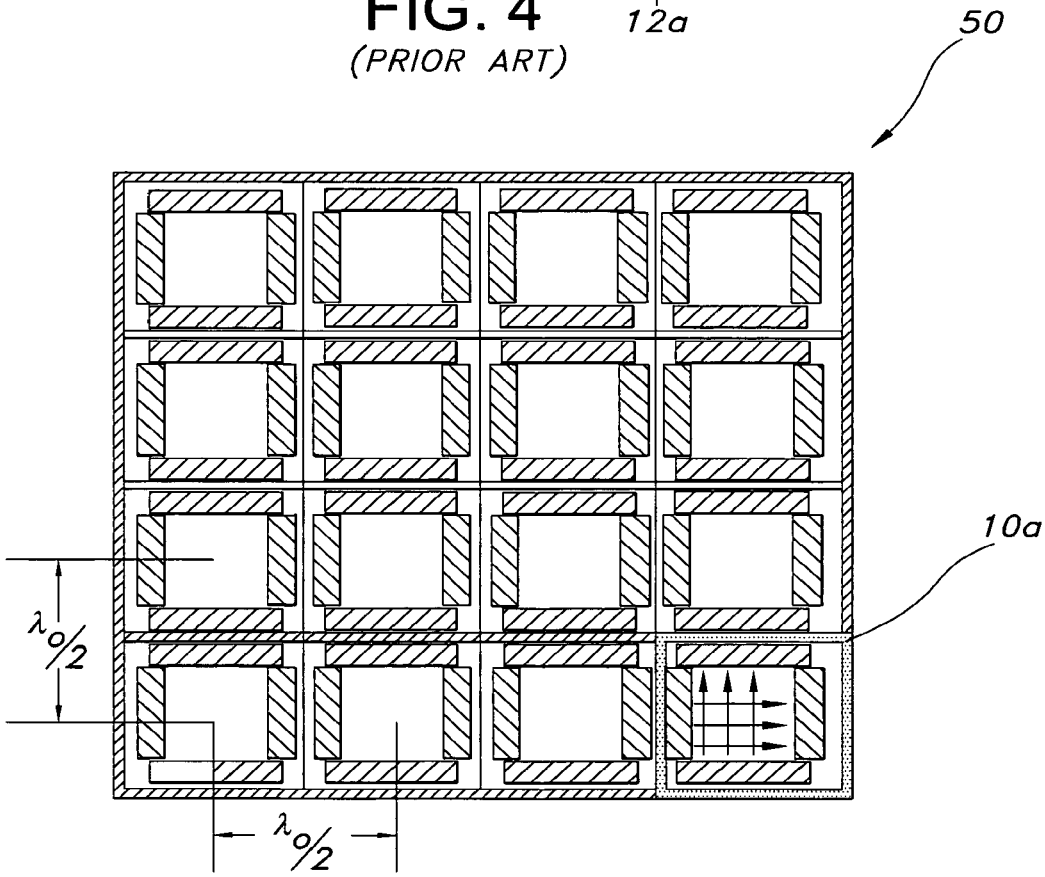
FIG. 5 (PRIOR ART)
FIG. 5 shows the prior art waveguide phase shifters of FIG. 4 combined into an electronically scanned antenna (ESA)

FIG. 4 shows the prior art waveguide phase shifter 10 of FIG. 1 modified into a dual-band phase shifter 10*a* having EBG devices 15 on vertical waveguide walls 12 of a square waveguide for low-frequency ($f_{lower}$) operation and EBG devices 15*a* on horizontal waveguide walls 12*a* for high-frequency ($f_{upper}$) operation. The waveguide phase shifters 10*a* may be combined into a prior art ESA 50 shown in FIG. 5. The waveguide phase shifter 10*a* utilizes the same size waveguide aperture for both modes and frequencies of operation in the ESA 50. The ESA 50 works well when $f_{lower}$ and $f_{upper}$ are closely spaced in terms of wavelength. When $f_{lower}$ and $f_{upper}$ are widely spaced, the aperture size necessary at $f_{upper}$ for grating lobe suppression in the ESA 50 forces the cross section of the low-frequency phase shifter to be narrow in terms of wavelength. This creates a situation in which the waveguide is so far off resonance with respect to $f_{lower}$ that large losses result. This occurs with desired MILSTAR frequencies such as 20 and 44 GHz.

Array theory dictates an element-to-element spacing of less than one half wavelength ($\lambda_o/2$ in FIG. 5) for a uniformly spaced array in order to suppress grating lobes as the main beam is scanned off bore sight. For a dual-band ESA, this requirement must be satisfied at both frequencies and therefore the element spacing is set based on the upper frequency band. In the case of the EBG ESA 50, the elements are a grid of square waveguide phase shifters 10*a* with tunable EBG devices 15 on each of the four sidewalls, with opposite EBG device pairs controlling the phase at one of the operating bands. The phase shift and loss of each EBG waveguide phase shifter 10*a* is directly related to its electrical size. As such, the lower frequency often suffers from the constraints placed on the EBG waveguide dimensions by the upper frequency.

Figure 6:
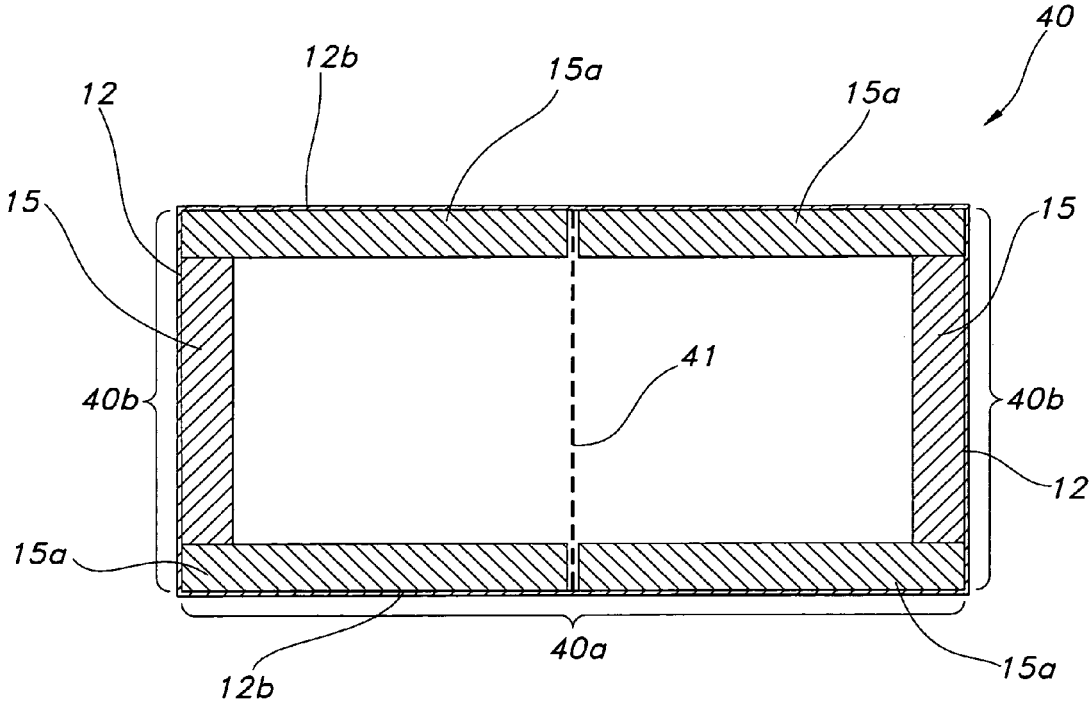
FIG. 6 (PRIOR ART)
FIG. 6 shows a prior art low-loss, dual-band EBG phase shifter that has a frequency selective surface (FSS) that is opaque at a high frequency and transparent at a low frequency.

The referenced application Ser. No. 11/154,256, now issued as U.S. Pat. No. 7,151,507 on Dec. 19, 2006, discloses a novel method to increase a broadwall of an equivalent EBG waveguide for the lower frequency while maintaining the necessary element spacing at the upper frequency. A low-loss, dual-band EBG phase shifter 40 of the co-pending application, shown in FIG. 6, utilizes a frequency selective surface (FSS) 41 that is opaque at $f_{upper}$ and transparent at $f_{lower}$ such that a horizontal broadwall 12*b* of the waveguide at $f_{lower}$ is substantially doubled over the horizontal waveguide wall 12*a* of FIG. 4, thereby approximately doubling an aperture size at $f_{lower}$ while maintaining a necessary aperture size at $f_{upper}$. Each waveguide width is now effectively the same in terms of wavelength for 20/44-GHz operation. Consequently, low-loss, dual-polarization operation at widely spaced frequencies is enabled.

Figure 7:
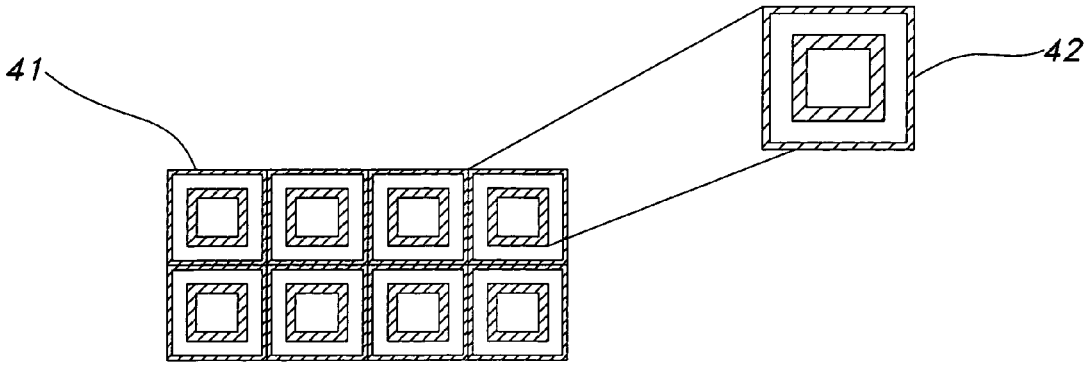
FIG. 7 (PRIOR ART)
FIG. 7 is a diagram showing an example frequency selective surface with a pattern, of the prior art, that may be etched on a high-frequency material substrate.

The surface 41 that appears opaque at $f_{upper}$ and transparent at $f_{lower}$ must be designed for use as a sidewall. Frequency selective surfaces (FSS) are known in the art and offer a simple method by which to achieve the surface 41. An FSS is a periodic surface of identical elements that exhibits a frequency dependent behavior. The FSS 41 may be formed on high-frequency material substrates using printed circuit techniques. A pattern that may be etched on the FSS 41 is shown in FIG. 7 to create the FSS 41. In FIG. 7 the FSS 41 is made up of a plurality of unit cells having an etched square 42. Other shapes may be used to form the FSS 41.

Referring back to FIG. 6, the low-loss, dual-band EBG phase shifter 40, hereinafter referred to as an FSS phase shifter 40 has low-frequency EBG devices 15 on the vertical waveguide walls 12 along with horizontal waveguide broadwalls 12*b* that are substantially twice the width of the vertical waveguide walls 12 and the horizontal waveguide walls 12*a* of FIG. 4 to form a low-frequency phase shifter 40*a*. The FSS 41, located at the center of the horizontal waveguide broadwalls 12*b*, appears transparent at the low frequency. Two high-frequency phase shifters 40*b* are formed in the FSS phase shifter 40. Each high-frequency phase shifter 40*b* comprises a vertical waveguide wall 12, the FSS 41, half of the horizontal broadwalls 12*b*, and high-frequency EBG devices 15*a* on half of the horizontal broadwalls 12*b*. The FSS 41 is common to both high-frequency phase shifters 40*b* and is opaque at the high frequency of operation. The FSS phase shifter 40 is a lower cost solution than that shown in FIG. 4 for an ESA due to the reduction in EBG devices 15 at $f_{lower}$.

Figure 8:
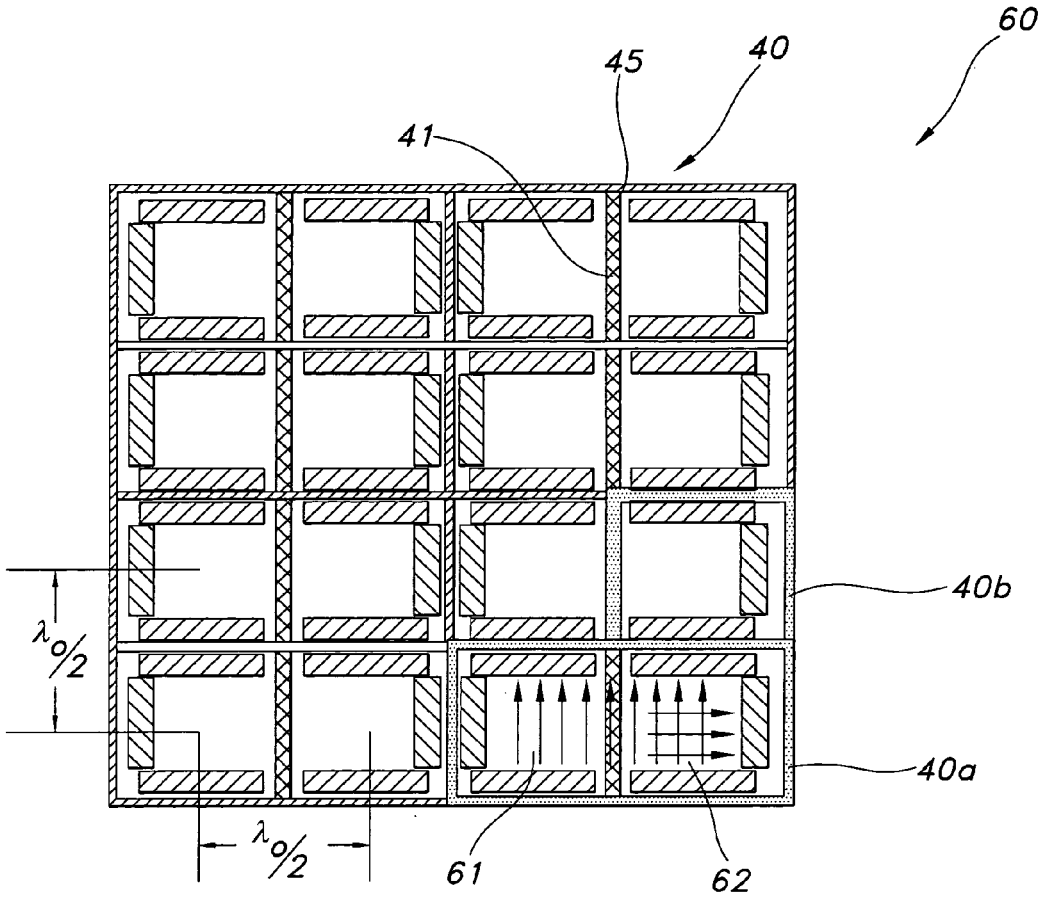
FIG. 8 (PRIOR ART)
FIG. 8 is a diagram showing the FSS phase shifters combined into a low-loss, dual-band, EBG ESA of the prior art.

FSS phase shifters 40 may be combined into a low-loss, dual-band, EBG FSS ESA 60 shown in FIG. 8. The FSS ESA 60 is shown with eight FSS phase shifters 40 in FIG. 8 but any number may be used. The FSS ESA 60 comprises eight low-frequency phase shifters 40*a* and sixteen high-frequency phase shifters 40*b* in the configuration shown in FIG. 8. The FSS 41 for each FSS phase shifter 40 may be an FSS slat 45 that extends vertically through the FSS ESA 60 when using the construction techniques of U.S. Pat. No. 6,822,617. Every other slat of the FSS ESA 60 is an FSS slat 45.

An FSS ESA 60 can be constructed using a plurality of FSS phase shifters 40 by arranging them in a grid with common walls and controlling the phase shift of each phase shifter 40 as shown in FIG. 8. Each FSS phase shifter 40 is a TEM open-ended waveguide with a fully integrated 360-degree analog phase shifter capable of operating simultaneously at two independent frequencies. The entire ESA structure 60 is capable of forming two independently steerable beams in two different frequency bands such as 20/44 GHz SATCOM. In FIG. 8, arrows 61 show polarization of the electric field for the low frequency and arrows 62 show polarization of the electric field for the high frequency.

Figure 9:
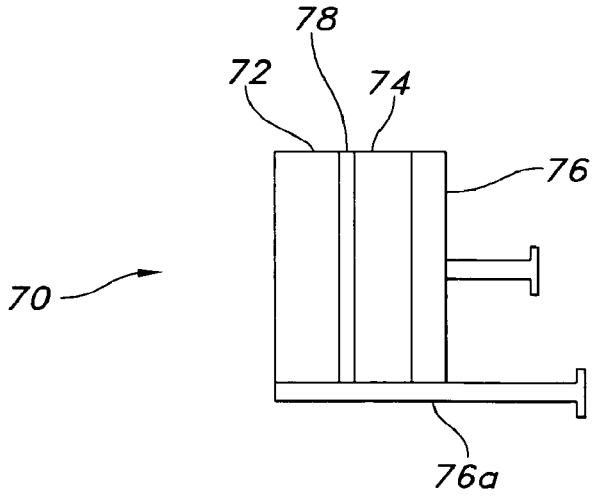
FIG. 9 shows a side view of the present invention for a dual-band stacked EBG ESA with independent feeds.

In the present invention for a dual-band stacked EBG ESA 70, shown in side view in FIG. 9, two different EBG waveguide apertures, a low-frequency aperture 72 for a frequency such as 20 GHz and a high-frequency aperture 74 for a frequency such as 44 GHz are created and stacked along with a high-frequency feed 76 and low-frequency feed 76*a* to form a single-aperture EBG ESA 70 with independent feeds capable of providing adequate phase shift at both the upper and lower operating frequencies while minimizing loss.

Figure 10A:
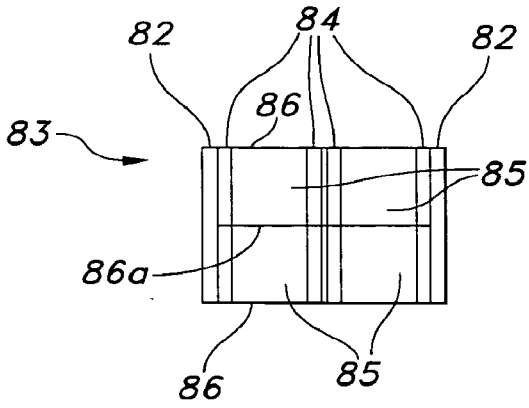
FIG. 10*a* is a diagram of a first embodiment of the dual-band stacked EBG ESA of FIG. 9 for operation with the same polarization.
Figure 10B:
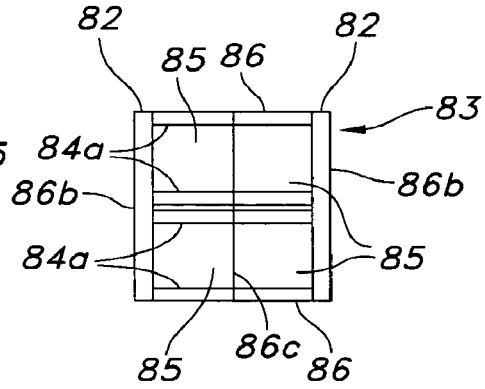
FIG. 10*b* is a diagram of a second embodiment of the dual-band stacked EBG ESA of FIG. 9 formed for operation with orthogonal polarization.

FIGS. 10*a* and 10*b* depict front views of individual cells for two alternative dual-band stacked EBG aperture embodiments for the EBG ESA 70 of FIG. 9. These concepts are applicable for the case when the two bands are widely separated in frequency, in this example 20 GHz and 44 GHz or approximately 2:1. FIG. 10*a* shows the stacked aperture construction when the low-frequency aperture 72 of FIG. 9 and the high-frequency aperture 74 of FIG. 9 have the same polarization. FIG. 10*b* shows the construction when the two apertures 72 and 74 have orthogonal polarization.

FIGS. 10*a* and 10*b* show a single low-frequency cell 83 cell for the low-frequency aperture 72 and four high-frequency cells 85 for the high-frequency aperture 74. The EBG ESA 70 may comprise a plurality of cells to form the low-frequency apertures 72 and the associated high-frequency apertures 74 arranged in an m×n or similar array.

The single low-frequency cell 83 in the low-frequency aperture 72, shown in both FIGS. 10*a* and 10*b*, is formed from two vertical low-frequency EBG sidewalls 82 and two horizontal metal walls 86. Four high-frequency cells 85 in the high-frequency aperture 74 of FIG. 10*a* are formed from four vertical high-frequency EBG sidewalls 84, two horizontal top and bottom metal walls 86 and one center horizontal metal wall 86*a*. In FIG. 10*b* the high-frequency aperture is formed from four horizontal EBG sidewalls 84*a*, two left and right vertical metal walls 86*b* and one center vertical metal wall 86*c*. The lattice spacing of the high-frequency aperture 74 in both FIGS. 10*a* and 10*b* is twice as dense as that of the low-frequency aperture 72.

The high-frequency aperture 74 looks through the low-frequency aperture 72 since the off-frequency nature of the low-frequency EBG sidewalls 82 are effectively metallic-like due to strip-to-strip capacitance and low diode impedance coupling (parallel polarization) and direct metallic current paths (orthogonal polarization). The low-frequency aperture 72 operates in a normal EBG ESA configuration, while at the high frequency it creates a $1\lambda \times 1\lambda TE_{10}$ waveguide aperture that has a phase slope generated by the high-frequency aperture 74 behind it. The high-frequency aperture 74 also operates as an EBG ESA. The low-frequency aperture 72 thus enables both low-frequency and high-frequency steered beams.

A frequency selective surface (FSS) 78, shown in FIG. 9, provides isolation between the two apertures 72 and 74. The FSS 78 may be constructed similar to the FSS 41 of FIG. 7. The FSS 78 appears as a low impedance (opaque) to the low frequency and transparent to the high frequency. Therefore both apertures 72 and 74 together appear as a complete high-frequency array.

Feed mechanisms for both configurations shown FIGS. 10*a* and 10*b* are illustrated in FIG. 9. The high-frequency feed 76 may be a space feed, semi-constrained feed or constrained feed. The low-frequency aperture 72 is an independently fed vertical subarray with either a series-series or parallel-series architecture low-frequency feed 76*a* from the bottom of the low-frequency aperture 72. FIG. 9 depicts a parallel-series feed.

Figure 11A:
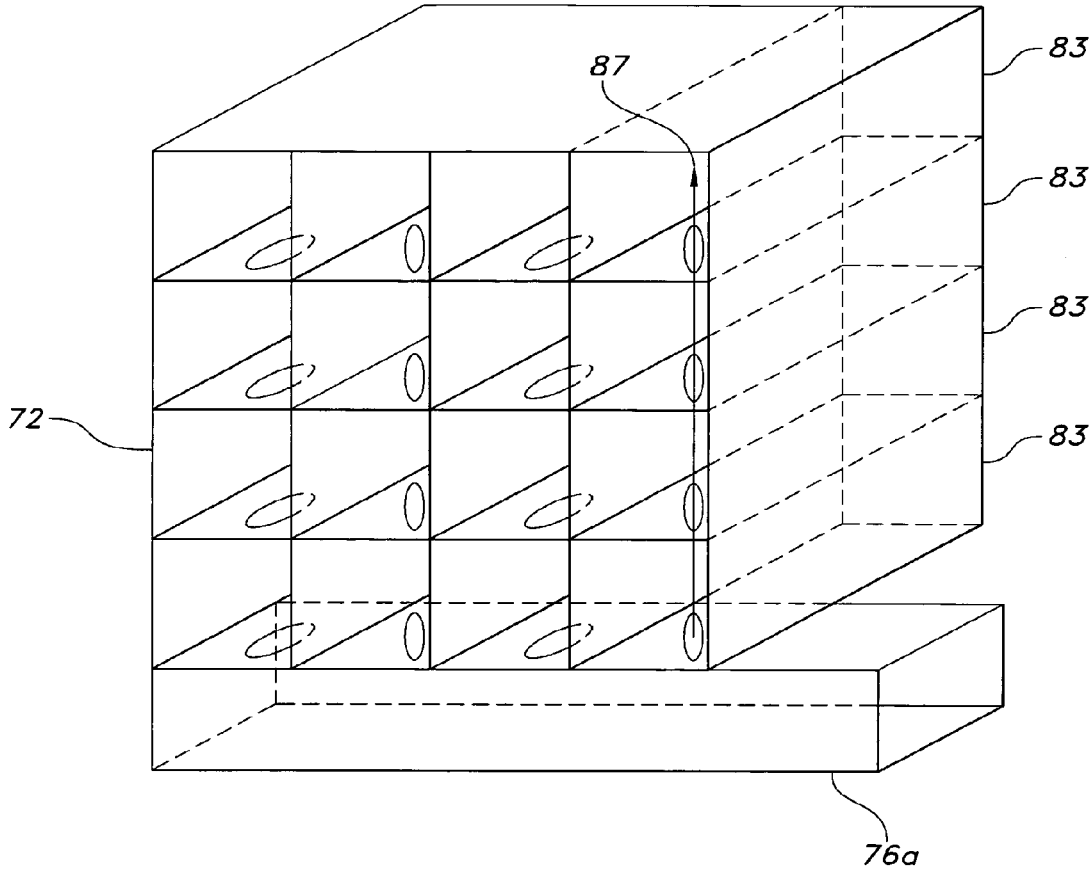
FIG. 11*a* illustrates a rear view a low-frequency aperture with a series-series feed.

FIG. 11*a* illustrates a rear view of the low-frequency aperture 72 with a series-series low-frequency feed 76*a*. The high frequency aperture 74 (not shown for clarity) looks into the low frequency aperture 72 from the rear. A waveguide feed

76*a* feeds a linear array of low-frequency cells 83 within the low-frequency aperture 72 in series through either E-field probe coupling or aperture coupling (shown in FIG. 11*a*) from one low-frequency cell to the next low-frequency cell in a vertical path as shown by arrow 87 from the low-frequency feed 76*a*. Only one vertical path is shown with arrow 87 in FIG. 11*a*. Adjacent columns of low-frequency cells are fed in a similar manner. The low-frequency feeds 76*a* depicted in FIGS. 9 and 11*a* are constrained waveguide architectures, preferred due to loss. Stripline, microstrip, coplanar waveguide, fin line, etc. are alternate constrained feed embodiments.

Figure 11B:
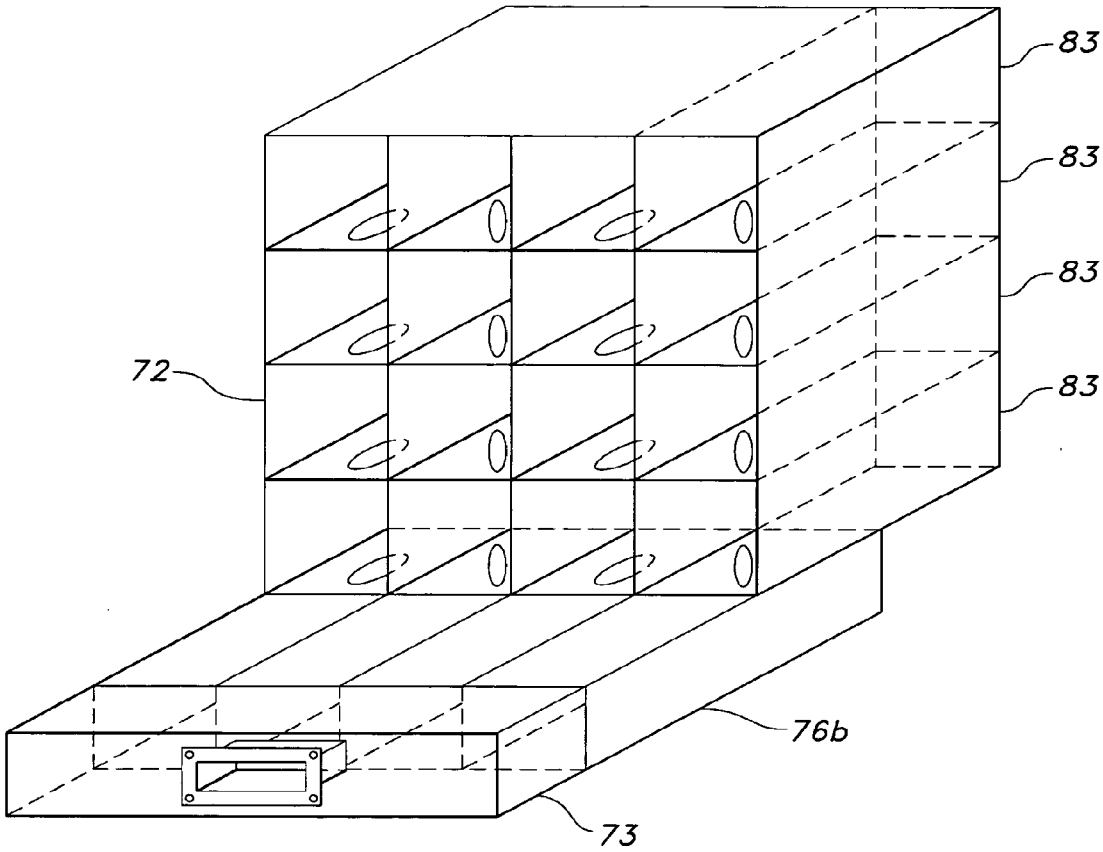
FIG. 11*b* shows a rear view of the low-frequency aperture with a parallel-series low-frequency feed.

FIG. 11*b* shows a rear view of the low-frequency aperture 72 with a parallel-series low-frequency feed 76*b*. The high frequency aperture 74 (not shown for clarity) looks into the low frequency aperture 72 from the rear. Parallel waveguides in feed 76*b* feed the linear array of low-frequency cells 83 within the low-frequency aperture 72 in parallel again through either E-field probe coupling or aperture coupling (shown in FIG. 11*b*) from one low-frequency cell to the next low-frequency cell in a vertical path as in FIG. 11*a*. A low frequency combiner 73 feeds the waveguides in feed 76*b*.

Figure 12A:
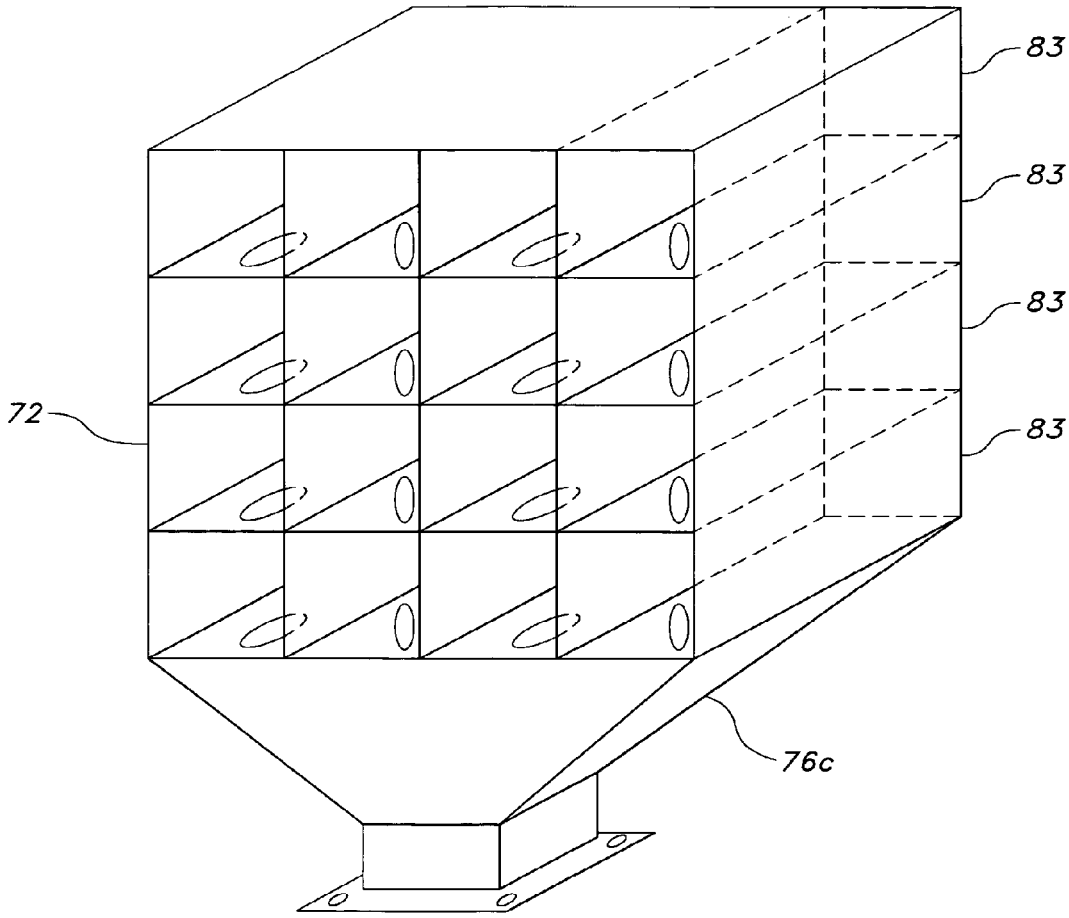
FIG. 12*a* illustrates a semi-constrained sector horn parallel-series feed feeding the low-frequency aperture.
Figure 12B:
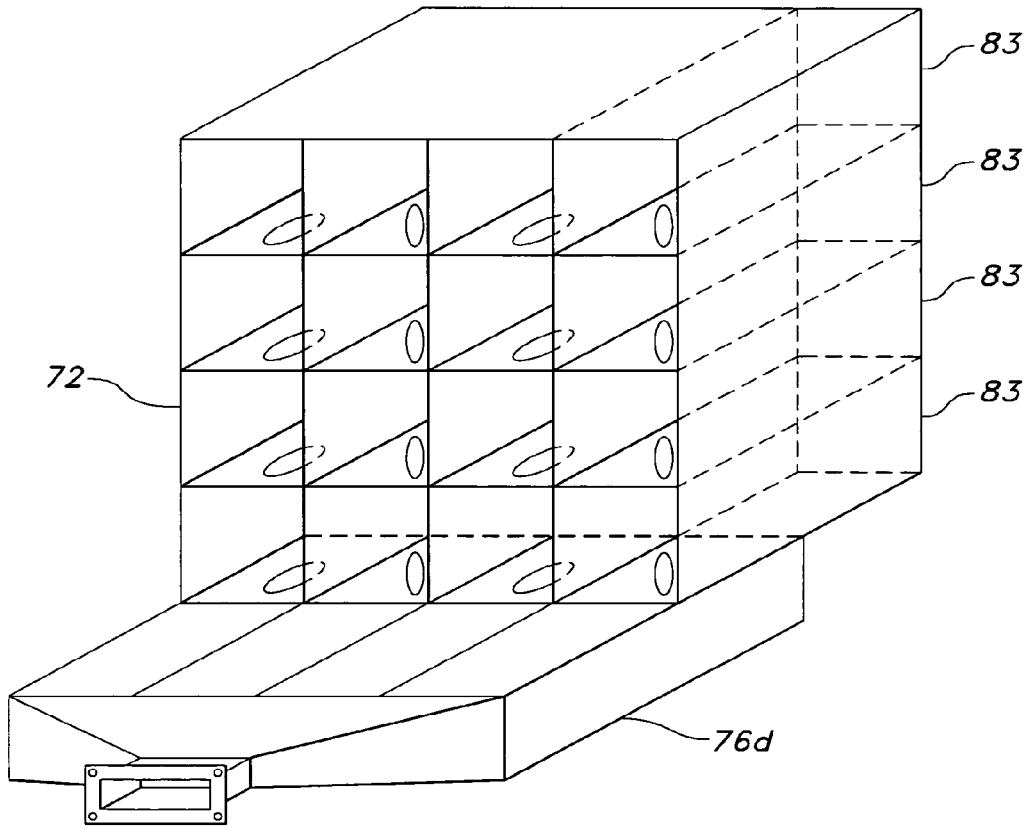
FIG. 12*b* illustrates a semi-constrained sector horn parallel-parallel horn feed feeding the low-frequency aperture where 72 is the same low frequency aperture of FIGS. 9 and 83 is the unit cell shown in FIG. 10.

A semi-constrained sector horn feed 76*c*, shown in FIG. 12*a*, is an alternative to constrained feeds. FIG. 12*a* shows a rear view of the low-frequency aperture 72 with a parallel-series horn feed 76*c* feeding the low-frequency aperture 72 low-frequency cells 83 through aperture coupling slots. This concept may also be adapted to parallel (semi constrained) series (constrained) feed 76*d* shown in FIG. 12*b*.

The stacked EBG ESA 70 in FIG. 9 may use a feed horn (not shown) to illuminate one face of the ESA 70 supplying a signal to each high-frequency cell in the high-frequency aperture 74 spatially. Each high-frequency cell applies the required amount of phase shift to steer a radiated beam to a desired direction. A spatial feed is a common low-cost method that has the advantage of simplicity and minimal RF interconnects.

The high-frequency aperture 74 may be fed with constrained or semi-constrained feeds 76. The semi-constrained feed is a space feed directly abutted to the aperture 74. In the constrained feed, a signal is individually routed to each phase shifter cell by a waveguide or other transmission line. This method, although being more complex and requiring a greater amount of RF interconnect, has the advantages of being more physically compact, no spillover as with a space feed, precise amplitude control, and generally has less degradation due to mutual coupling.

The EBG ESA 70 of FIG. 9 may be constructed used an approach disclosed in U.S. Pat. No. 6,822,617 entitled "A Construction Approach for EMXT-Based Phased Array Antenna." This patent describes a construction approach for a single-band phased array antenna. The approach can easily be expanded to the dual-band stacked EBG ESA.

It is believed that the stacked dual-band electromagnetic band gap (EBG) waveguide aperture with independent feeds of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A dual-band stacked electromagnetic band gap (EBG) electronically scanned array (ESA) with independent feeds comprising:

a low-frequency aperture;

a high-frequency aperture stacked on the low-frequency aperture wherein the high-frequency aperture looks through the low-frequency aperture;

a low-frequency feed to feed the low-frequency aperture at the low frequency;

a high-frequency feed stacked on the high-frequency aperture to feed the high-frequency aperture at the high frequency; and wherein the high-frequency feed feeds the high-frequency aperture from a face of an array of high frequency cells and comprises one of a space feed, a semi-constrained feed, and a constrained feed.

2. A dual-band stacked electromagnetic band gap (EBG) electronically scanned array (ESA) with independent feeds comprising:

a low-frequency aperture;

a high-frequency aperture stacked on the low-frequency aperture wherein the high-frequency aperture looks through the low-frequency aperture;

a low-frequency feed to feed the low-frequency aperture at the low frequency;

a high-frequency feed stacked on the high-frequency aperture to feed the high-frequency aperture at the high frequency; and wherein the low-frequency feed feeds the low-frequency aperture from the bottom and comprises one of a series-series feed, a parallel-series feed, constrained feed, semi-constrained sector horn.

3. A dual-band stacked electromagnetic band gap (EBG) electronically scanned array (ESA) with independent feeds comprising:

a low-frequency aperture;

a high-frequency aperture stacked on the low-frequency aperture wherein the high-frequency aperture looks through the low-frequency aperture;

a low-frequency feed to feed the low-frequency aperture at the low frequency;

a high-frequency feed stacked on the high-frequency aperture to feed the high-frequency aperture at the high frequency;

wherein the low-frequency aperture comprises a plurality of low-frequency cells wherein each of said cells comprises two vertical low-frequency EBG sidewalls and two horizontal metal walls; and wherein the high-frequency aperture comprises a plurality of high-frequency cells wherein four of said cells are stacked on each of said low-frequency cells and said four high-frequency cells comprise four vertical high-frequency EBG sidewalls, two horizontal metal top and bottom metal walls, and a center horizontal metal wall.

4. The dual-band stacked EBG ESA of claim 3 wherein the low-frequency aperture and the high-frequency aperture have the same polarization.

5. A dual-band stacked electromagnetic band gap (EBG) electronically scanned array (ESA) with independent feeds comprising:

a low-frequency aperture;

a high-frequency aperture stacked on the low-frequency aperture wherein the high-frequency aperture looks through the low-frequency aperture;

a low-frequency feed to feed the low-frequency aperture at the low frequency;

a high-frequency feed stacked on the high-frequency aperture to feed the high-frequency aperture at the high frequency;

wherein the low-frequency aperture comprises a plurality of low-frequency cells wherein each of said cells comprises two vertical low-frequency EBG sidewalls and two horizontal metal walls; and wherein the high-frequency aperture comprises a plurality of high-frequency cells wherein a different set of said four of said cells are stacked on each of said low-frequency cells and said different set comprises four horizontal high-frequency EBG sidewalls, two vertical left and right metal walls, and a center vertical metal wall.

6. The dual-band stacked EBG ESA of claim 3 wherein the low-frequency aperture and the high-frequency aperture have orthogonal polarization.

7. A dual-band stacked electromagnetic band gap (EBG) electronically scanned array (ESA) with independent feeds comprising:

a low-frequency aperture;

a high-frequency aperture stacked on the low-frequency aperture wherein the high-frequency aperture looks through the low-frequency aperture;

a low-frequency feed to feed the low-frequency aperture at the low frequency;

a high-frequency feed stacked on the high-frequency aperture to feed the high-frequency aperture at the high frequency; and further comprising a frequency selective surface between the low-frequency aperture and the high-frequency aperture to provide isolation therebetween.

8. The dual-band stacked EBG ESA of claim 7 wherein the frequency selective surface comprises a plurality of unit cells etched on high-frequency material substrates.

9. A dual-band stacked electromagnetic band gap (EBG) electronically scanned array (ESA) with independent feeds comprising:

a low-frequency aperture comprising a plurality of low-frequency cells wherein each of said cells comprises two vertical low-frequency EBG sidewalls and two horizontal metal walls;

a high-frequency aperture stacked on the low-frequency aperture wherein the high-frequency aperture looks through the low-frequency aperture and said high-frequency aperture comprises a plurality of high-frequency cells wherein a different array of four of said cells are stacked on each of said low-frequency cells and said different array comprises four vertical high-frequency EBG sidewalls, two horizontal metal top and bottom metal walls, and a center horizontal metal wall;

a low-frequency feed to feed the low-frequency aperture at the low frequency; and a high-frequency feed stacked on the high-frequency aperture to feed the high-frequency aperture at the high frequency.

10. The dual-band stacked EBG ESA of claim 9 wherein the low-frequency feed feeds the low-frequency aperture from the bottom and comprises one of a series-series and a parallel-series feed architecture.

11. The dual-band stacked EBG ESA of claim 9 wherein the high-frequency feed feeds the high-frequency aperture from a face of an array of high frequency cells and comprises one of a space feed, a semi-constrained feed, and a constrained feed.

12. The dual-band stacked EBG ESA of claim 9 further comprising a frequency selective surface between the low-frequency aperture and the high-frequency aperture to provide isolation therebetween.

13. The dual-band stacked EBG ESA of claim 12 wherein the frequency selective surface comprises a plurality of unit cells etched on high-frequency material substrates.

14. A dual-band stacked electromagnetic band gap (EBG) electronically scanned array (ESA) with independent feeds comprising:

a low-frequency aperture comprising a plurality of low-frequency cells wherein each of said cells comprises two vertical low-frequency EBG sidewalls and two horizontal metal walls;

a high-frequency aperture stacked on the low-frequency aperture wherein the high-frequency aperture looks through the low-frequency aperture and said high-frequency aperture comprises a plurality of high-frequency cells wherein a different array of four of said cells are stacked on each of said low-frequency cells and said different array comprises four horizontal high-frequency EBG sidewalls, two vertical left and right metal walls, and a center vertical metal wall;

a low-frequency feed to feed the low-frequency aperture at the low frequency; and a high-frequency feed stacked on the high-frequency aperture to feed the high-frequency aperture at the high frequency.

15. The dual-band stacked EBG ESA of claim 14 wherein the low-frequency feed feeds the low-frequency aperture from the bottom and comprises one of a series-series and a parallel-series feed architecture.

16. The dual-band stacked EBG ESA of claim 14 wherein the high-frequency feed feeds the high-frequency aperture from a face of an array of high frequency cells and comprises one of a space feed, a semi-constrained feed, and a constrained feed.

17. The dual-band stacked EBG ESA of claim 14 further comprising a frequency selective surface between the low-frequency aperture and the high-frequency aperture to provide isolation therebetween.

18. The dual-band stacked EBG ESA of claim 17 wherein the frequency selective surface comprises a plurality of unit cells etched on high-frequency material substrates.

* * * * *